US007651014B2

(12) United States Patent
Neuhaus et al.

(10) Patent No.: US 7,651,014 B2
(45) Date of Patent: Jan. 26, 2010

(54) METERING VALVE AND DEVICE FOR DISPENSING A PREFERABLY COSMETIC LIQUID

(75) Inventors: Reinhard Neuhaus, Hemer (DE); Bernhard Jasper, Waltrop (DE)

(73) Assignee: Seaquist Perfect Dispensing GmbH, Dortmund (DE)

( * ) Notice: Subject to any disclaimer, the term of this patent is extended or adjusted under 35 U.S.C. 154(b) by 446 days.

(21) Appl. No.: 11/570,866

(22) PCT Filed: Jun. 17, 2005

(86) PCT No.: PCT/EP2005/006531

§ 371 (c)(1), (2), (4) Date: Dec. 18, 2006

(87) PCT Pub. No.: WO2005/123542

PCT Pub. Date: Dec. 29, 2005

(65) Prior Publication Data

US 2007/0228081 A1 Oct. 4, 2007

(30) Foreign Application Priority Data

Jun. 17, 2004 (DE) ..... 10 2004 029 146
Jul. 16, 2004 (DE) ..... 10 2004 034 626

(51) Int. Cl.
*B65D 83/00* (2006.01)

(52) U.S. Cl. ..... 222/402.2; 222/1; 222/402.1; 222/402.24

(58) Field of Classification Search ..... 222/402.2, 222/1, 402.1, 394, 402.22, 402.23, 402.24, 222/402.25

See application file for complete search history.

(56) References Cited

U.S. PATENT DOCUMENTS

| | | | | |
|---|---|---|---|---|
| 2,721,010 | A | 10/1955 | Meshberg | |
| 2,837,249 | A | 6/1958 | Meshberg | |
| 3,018,928 | A | 1/1962 | Meshberg | |
| 3,055,560 | A | 9/1962 | Meshberg | |
| 3,073,489 | A | 1/1963 | Friedman | |
| 4,811,868 | A * | 3/1989 | Nitta | 222/402.2 |
| 5,027,985 | A * | 7/1991 | Abplanalp | 222/402.1 |
| 5,769,283 | A | 6/1998 | Owada et al. | |
| 6,978,916 | B2 | 12/2005 | Smith | |
| 2002/0190085 | A1 | 12/2002 | Stanford | |
| 2003/0071080 | A1 | 4/2003 | Yquel | |
| 2004/0139966 | A1 | 7/2004 | Hodson | |

* cited by examiner

*Primary Examiner*—Frederick C. Nicolas
(74) *Attorney, Agent, or Firm*—David S. Safran; Roberts Mlotkowski Safran & Cole, P.C.

(57) ABSTRACT

A metering valve (2) and a device (1) provided with it for metered dispensing of a preferably cosmetic liquid (3) and a process for producing such a metering valve (2) and a use of such a metering valve (2) are suggested. The metering valve has a valve element (6) with a spring section (21) which is elastic in the direction of motion and which bears a sealing element (14). This allows especially sealed contact with the assigned valve seat when the inlet valve (9) is closed.

20 Claims, 1 Drawing Sheet

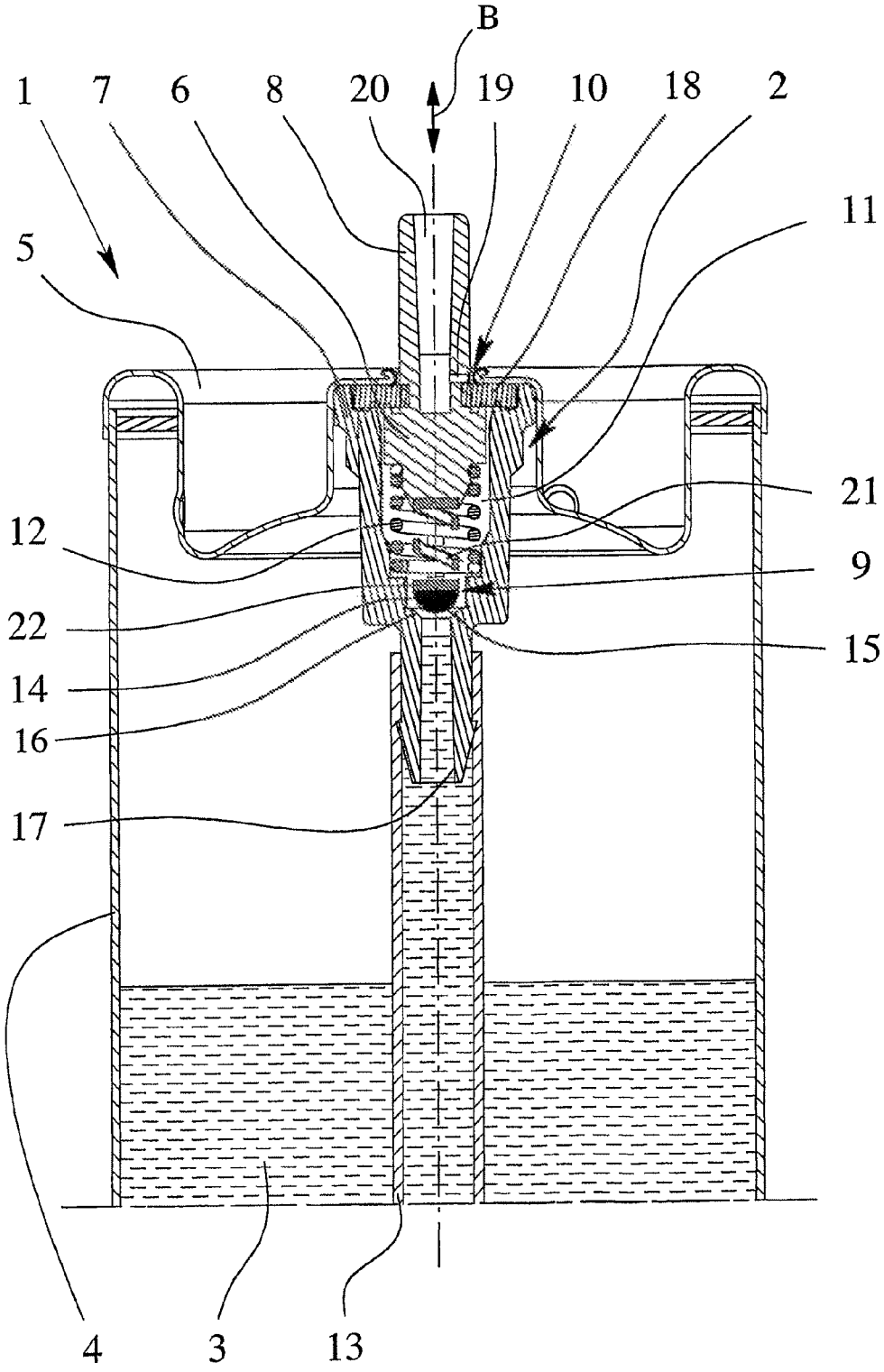
B
1
7
6
8
20
19
10
18
2
11
5
21
12
9
22
15
14
16
17
4
3
13

METERING VALVE AND DEVICE FOR DISPENSING A PREFERABLY COSMETIC LIQUID

BACKGROUND OF THE INVENTION

1. Field of the Invention

This invention relates to a metering valve for dispensing a preferably cosmetic liquid, a device with such a metering valve, a process for producing such a metering valve, and use of such a metering valve or such a device.

2. Description of Related Art

The concept of "cosmetic liquid" includes in a narrow sense hair spray, hair lacquer, a deodorant, a foam, a gel, a coloring spray, a sunscreen or skin care agent or the like. Preferably, in a wider sense also other body care products, cleaning products, cosmetics, or the like, and also suspensions and fluids, especially with gaseous phases, are included. But other liquids, for example air fresheners, and especially also technical liquids and fluids, such as rust looseners or the like, can also be used. But for reasons of simplification and based on the focus of use often only cosmetic liquids are addressed below.

U.S. Patent Application 2003/0230603 A1 (U.S. Pat. No. 6,978,916) discloses a device for metered atomization of a cosmetic liquid, a container which contains the liquid having a metering valve with a movable valve element in a valve housing. The valve element together with the valve housing forms a supply-side inlet valve and a dispensing-side outlet valve. The valve element is preferably provided with a slipped-on spray head or the like for dispensing and atomization of the liquid. By pressing down on the spray head, the valve element is moved axially, by which, first, the supply-side inlet value of the metering valve is closed and only then is the dispensing-side outlet valve of the metering valve opened. Then, the liquid which preferably contains a propellant can escape from the metering space formed in the valve housing and can be atomized and delivered by the connected spray head.

To achieve the desired sealing action between the valve element, on the one hand, and the valve housing, on the other, a seal is injected onto the movable valve element and seals axially when the inlet valve is closed. The known metering valve does not allow optimum sealing.

SUMMARY OF THE INVENTION

The object of this invention is to devise a metering valve and a device for metered dispensing of a preferably cosmetic liquid and a process for producing such a metering valve and use of such a metering valve or such a device, the metering valve allowing optimum sealing and being more versatile.

This object is achieved by a metering valve, a device, a process and a use as described below.

In accordance with the invention, the valve element has a spring segment which is elastic in the direction of motion and an adjoining head section, the head section preferably forming the inlet valve and bearing especially the preferably injected-on sealing element. This yields a very simple structure with few parts so that economical production and mounting are enabled. Furthermore, this enables optimized sealing since the head section with the sealing element can rest against an assigned valve seat on the valve housing or can engage it, sealing optimally.

The sealing element is preferably made of a softer or more elastic material than the valve element and the valve housing. This enables a much more stable execution of the metering valve, especially of the valve housing which can, accordingly, better withstand high propellant and filling pressures. Therefore, the metering valve in accordance with the invention and the device provided with such a metering valve can be used in a versatile manner.

According to an especially preferred embodiment, the sealing element is injected directly onto the valve element. This can be done, for example, directly in the injection mold for the valve element. If necessary, the sealing element can also be inserted as a prefabricated part into the injection mold and the valve element can be injected onto the sealing element. In both cases, especially simple and economical production is enabled, and mounting can take place in the previously conventional manner without an additional mounting step for the sealing element.

The corresponding advantages arise when the sealing element is attached to the valve element especially by slipping it on.

Preferably, the sealing element is located in the region of the free end on the valve element. This is especially beneficial to a correspondingly end-side arrangement of the inlet valve and possible slipping of the sealing element onto the valve element.

Preferably, the sealing element, the valve element and the valve housing are each injection molded from plastic in order to enable economical mass production.

Preferably, injection molding takes place with such precision and such a selection of materials that reworking to achieve the desired sealing action is unnecessary.

In particular, the sealing element is made self-locking. This can be achieved, for example, by the sealing element engaging a preferably undercut recess of the valve element or of the valve housing. However, this is especially preferably achieved by the sealing element being injection molded directly onto the valve element or the valve or injection molded into it or vice versa in order to achieve permanent connection.

The metering valve is used especially preferably for metered dispensing of a cosmetic liquid which contains particles, distributed projections in a metering space of the metering valve being used for temporary deposition of particles to counteract bottom-side settling of particles and especially clogging of the inlet valve, the particles which have settled on the projections being discharged by the liquid during dispensing at the same time. This enables improved distribution of particles in the discharged liquid. This is beneficial to particle-containing formulations or suspensions which are being increasingly used to be able to ensure distributions as uniform as possible and thus uniform properties.

Other advantages, features, properties and aspects of this invention will become apparent from the following description of preferred embodiments with reference to the accompanying drawings.

BRIEF DESCRIPTION OF THE DRAWINGS

The sole FIGURE is a schematic cross-sectional view of a device in accordance with invention with a metering valve in accordance with invention for metered dispensing of a cosmetic liquid.

DETAILED DESCRIPTION OF THE INVENTION

The sole FIGURE shows, in a schematic cross section, a device 1 in accordance with invention with a metering valve 2 for metered dispensing of a preferably cosmetic liquid 3 or the like. In particular, dispensing of the liquid 3 proceeds via a spray head (not shown) which is connected to the metering valve 2, preferably slipped onto it, for atomization and discharge of the liquid 3.

The liquid 3 is under pressure or can be pressurized. In particular, the liquid 3 contains a propellant, preferably a volatile and/or flammable propellant, compressed gas, carbon dioxide or the like. Especially preferably, the cosmetic liquid 3 in the initially named sense is a particle-containing mixture or suspension.

Furthermore, the device 1 has a container 4 for the liquid 3 and a cover 5 which bears the metering valve 2.

The metering valve 2 has a movable valve element 6 and a valve housing 7. The valve element 6, in the illustrated embodiment, is guided to be axially moveable, in FIG. 1 vertically, in the valve housing 7 and on the dispensing side forms a projecting connector piece 8 for connection of the spray head, or the like. The metering valve 2 has a supply-side inlet valve 9, a dispensing-side outlet valve 10 and a metering space 11 formed in between in the valve housing 7.

In the metering space 11, there is a reset spring 12 which is assigned to the valve element 6 and which pretensions the valve element 6 into the illustrated, inactive position, here, therefore up.

In the inactive position, the outlet valve 10 is closed and the inlet valve 9 is opened. In this state, the metering space 11 is filled with the liquid 3 (in the FIGURE this is not shown for reasons of simplification), the liquid 3 being able to flow out of the container 4 via a supply-side ascending line 13 through the open inlet valve 9 into the metering space 11.

When the valve element 6 is actuated—therefore, when the valve element 6 is pressed down against the force of the reset spring 12—first, the inlet valve 9 is closed and only afterwards is the outlet valve 10 opened. In this actuated state, then, the liquid 3 located in the metering space 11 can be dispensed via the opened outlet valve 10, especially due to the indicated propellant it can flow out independently, and for example, can be sprayed or atomized by the spray head which is connected to the connector piece 8. The metering valve 2 accordingly dispenses only a certain or metered amount of liquid 3 with each actuation.

When the metering valve 2 is reset into the inactive position, first the outlet valve 10 is closed and only then is the inlet valve 9 opened in order to allow the liquid 3 to flow into the metering space 11.

The valve element 6 and the valve housing 7 are preferably made in one piece and are injection molded from plastic, especially from a relatively hard or stiff plastic, such as polyamide or polyoxymethylene (POM).

To seal the inlet valve 9 in the closed state, in accordance with invention, in addition, between the valve element 6 and the valve housing 7, there is a sealing element 14 of a softer or more elastic material than the valve element 6 and the valve housing 7.

Preferably, the sealing element 14 is injected onto the valve element 7, preferably directly in the injection mold used to produce the valve element 6 or in a separate injection mold. Alternatively, the sealing element 14 can also be inserted, for example, as a prefabricated part into the injection mold and the valve element 6 can be injected on or the sealing element 14 can be slipped onto the prefabricated valve element 6.

The sealing element 14 is preferably also injection molded, especially from a suitable elastomer, preferably from a thermoplastic elastomer (TPE), a thermoplastic polyurethane (TPU) or a low density polyethylene produced under high pressure (LDPE).

Injection molding enables economical mass production, especially reworking of the seal surfaces—on the one hand, on the sealing element 14, and on the other, on the valve element 6 or the valve housing 7—not being necessary.

The injection of the sealing element 14 onto the valve element 6 has the advantage that the sealing element 14 does not form a separate part, and therefore, does not require a separate mounting step, and moreover, has the further advantage that very good sealing can be achieved between the sealing element 14 and the valve element 6 or valve housing 7 connected to it without additional measures.

The sealing element 14 is located on the valve element 6, and in the illustrated embodiment, preferably has a truncated cone-shaped, conical, crowned, hemispherical or rounded insertion region 15, in order to facilitate insertion into the corresponding sealing section of the valve housing 7 for sealing against the sealing element 14 with the inlet valve 9 closed.

In the illustrated embodiment, the sealing element 14 is located on a free end of the valve element 6 such that, in the inactive state, an axial supply channel 17 in the valve housing 7 to the metering space 11 is not blocked. In the actuated state—therefore, with the valve element 6 pressed down—the valve element 14 is preferably inserted at least partially with the front end of the valve element 6 into the supply channel 17 for radial and/or axial sealing on the sealing section of the valve housing 7. But fundamentally, also other valve designs are possible, for example, a plate-shaped execution and/or axial sealing.

The preferably one-piece valve element 6, in the region of its front or free end, has a spring section 21 which is elastic in the axial direction or direction of movement B and an adjoining head section 22. The sealing element 14 is preferably located at least essentially solely on the front on the head section 22, preferably injected on.

In the illustrated embodiment, the inlet valve 9 seals at least essentially axially by the sealing element 14 making contact with a suitable, preferably conical shoulder region 16 or other valve seat of the valve housing 7 when the valve element 6 is actuated, by which the inlet valve 9 closes. In the course of further actuation of the valve element 6—therefore, as the valve element 6 continues to be pressed down—the spring section 21 is axially compressed and finally the outlet valve 10 is opened. In this compressed state, the spring force which acts in the closing direction of the inlet valve 9, and which is applied by the spring section 21, is high enough to keep the inlet valve 9 closed against the pressure prevailing in the container 4.

The spring section 21 allows improved sealing between the sealing element 14 and the valve housing 7 or a valve seat since the sealing element 14 can optimally uniformly rest against the valve seat, especially radial and axial tolerances and tilting can be compensated or incorporated into the design.

The outlet valve 10 in the illustrated embodiment has a separate sealing element 18 which is made especially annular and is sealed by the valve housing 7 against an annular section of the cover 5. The separate sealing element 18 seals radially relative to the shaft section of the valve element 6 or the connector piece 8. In the illustrated inactive state, the outlet valve 10 is closed, and accordingly, no liquid 3 can emerge from the metering space 11 on the dispensing side.

When the valve element 6 is actuated, the valve element 6 or the connector piece 8 is shifted axially such that a radial passage channel 19 moves past the separate sealing element 18 into the interior of the valve housing 7, therefore is released toward the metering space 11 (this position is not shown). Thus, the outlet valve 10 is opened, and the liquid 3 can flow out of the metering space 11 through the passage channel 19 into an axial recess 20 and through the latter out of the connector piece 8 into the spray head which is not shown, or the like.

If necessary, the sealing element 14 which has been injected on or optionally also can be used for other valves—therefore independently of this metering valve 2—for this or a similar device 1 for dispensing and especially atomization of cosmetic liquids 3.

In general, the device 1 in accordance with invention and the metering valve 2 in accordance with invention can be used for any type of cosmetic liquids 3, as explained above. However, the use of such a metering valve 2 or a similar one is especially suited for metered dispensing of a cosmetic liquid 3 which contains particles, projections distributed in a metering space 11 of the metering valve 2 being used for temporary deposition of particles in order to counteract bottom-side settling of particles and especially clogging of the inlet valve 9 of the metering valve 2, and the particles being discharged again by the liquid 3 in dispensing. In the position of use of the metering valve 2 and container 1, the projections are preferably distributed in the vertical direction or spaced apart and especially preferably are formed by the turns of the reset spring 12 and/or other recesses, bulges, edges or the like of the valve element 6 and/or valve housing 7 in the metering space 11.

In the delivery of the liquid 2—therefore, when the actuated state of the metering valve 2 is reached—then, the particles which have settled on the projections are entrained by the outflowing liquid 3 and thus distributed at least largely uniformly in the liquid 3, especially during subsequently spraying.

What is claimed is:

1. Metering valve metered dispensing of a liquid, comprising:

a valve element that is movable between a closed position and an open position, a valve housing, a supply side inlet valve having a sealing element for sealing between the valve element and the valve housing in a closed position thereof, and a dispensing side outlet valve, wherein the valve element, by actuation thereof, is adapted to close the inlet valve before opening of the outlet valve for metered dispensing of a liquid, wherein the valve element has a spring section, which is elastic in a direction in which the valve element is movable, and has an adjoining head section with the sealing element, and wherein the sealing element is formed of a material that is one of softer and more elastic than that of the valve element and the valve housing.

2. Metering valve as claimed in claim 1, wherein the sealing element has been injection molded onto the valve element.

3. Metering valve as claimed in claim 1, wherein the valve element has been injection molded onto the sealing element.

4. Metering valve as claimed in claim 1, wherein the sealing element is located in a region of a free end on the valve element.

5. Metering valve as claimed in claim 1, wherein the sealing element forms the head section.

6. Metering valve as claimed in claim 1, wherein the sealing element is molded onto the head section and has one of hemispherical and truncated conical shape.

7. Metering valve as claimed in claim 1, wherein the sealing element has a truncated cone-shaped or rounded insertion region for engaging the valve housing.

8. Metering valve as claimed in claim 1, wherein the sealing element and at least one of the valve element and the valve housing are formed in one piece with each other.

9. Metering valve as claimed in claim 1, wherein at least one of the sealing element, the valve element and the valve housing is made of injection molded plastic.

10. Metering valve as claimed in claim 1, wherein the sealing element made of an injection molded elastomer.

11. Metering valve as claimed in claim 1, wherein at least one of the valve element and the valve housing is of polyamide or polyoxymethylene.

12. Metering valve as claimed in claim 1 wherein the inlet valve has a valve seat formed by the valve housing.

13. Metering valve as claimed in claim 12, wherein the spring section allows tilting of the sealing element with the inlet valve closed for sealed contact with the valve seat.

14. Metering valve as claimed in claim 1, wherein the valve element comprises both the inlet valve and also the outlet valve.

15. Device for metered dispensing of a liquid, comprising:

a container for the liquid, and a metering valve, wherein the metering valve comprises:

a valve element that is movable between a closed position and an open position, a valve housing, a supply side inlet valve having a sealing element for sealing between the valve element and the valve housing in a closed position thereof, and a dispensing side outlet valve, wherein the valve element, by actuation thereof, is adapted to close the inlet valve before opening of the outlet valve for metered dispensing of a liquid wherein the valve element has a spring section, which is elastic in a direction in which the valve element is movable, and has an adjoining head section with the sealing element, and wherein the sealing element is formed of a material that is one of softer and more elastic than that of the valve element and the valve housing.

16. Device as claimed in claim 15, wherein the container is one of under pressure, pressurizable, and contains a propellant.

17. Device as claimed in claim 15, wherein the liquid is an atomizable liquid.

18. Device as claimed in claim 15, wherein the liquid is a liquid selected from the group consisting of a hair spray, a hair lacquer, a deodorant, a foam, a gel, a coloring spray, a sunscreen, a skin care agent, a cleaning agent and an air freshener.

19. Process for producing a metering valve for metered dispensing of a liquid, having a valve element that is movable between a closed position and an open position, a valve housing, a supply side inlet valve having a sealing element for sealing between the valve element and the valve housing in a closed position thereof, and a dispensing side outlet valve, wherein the valve element, by actuation thereof, is adapted to close the inlet valve before opening of the outlet valve for metered dispensing of the liquid and wherein the valve element has a spring section, which is elastic in a direction in which the valve element is movable, and has an adjoining head section with the sealing element, comprising the steps of injection molding at least one of the movable valve element and the valve housing of the metering valve from a plastic material, selecting a material for forming of the sealing element which is of one of softer or more elastic material than that of the valve housing, injection molding the sealing element from the selected material directly onto one of the valve element and the valve housing.

20. Process as claimed in claim 19, wherein injection molding of the sealing element is performed in the same injection mold as used for said injection molding of said one of the valve element and valve housing.

* * * * *